US005923919A

United States Patent [19]

Nimura et al.

[11] Patent Number: 5,923,919

[45] **Date of Patent: *Jul. 13, 1999**

[54] IMAGE FORMING APPARATUS WITH POWER SHUT-OFF DEVICE

[75] Inventors: Mitsuo Nimura, Kashiwa; Kunio Tsuruno, Tokyo; Masatoshi Tanabe, Toride, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/704,233

[22] Filed: Aug. 28, 1996

[30] Foreign Application Priority Data

Aug. 30, 1995 [JP] Japan ..... 7-221763

[51] Int. Cl.[6] ..... G03G 15/00

[52] U.S. Cl. ..... 399/37; 399/17; 399/88

[58] Field of Search ..... 399/37, 83, 85, 399/87, 88, 17, 19, 20, 18

[56] References Cited

U.S. PATENT DOCUMENTS 3,970,384 7/1976 Yamamoto et al. .
4,474,454 10/1984 Sugiura ..... 399/21
4,615,609 10/1986 Honma ..... 399/88
4,708,461 11/1987 Okuda et al. ..... 399/87
4,745,436 5/1988 Matsuura ..... 399/70
4,791,453 12/1988 Koseki et al. ..... 399/82
4,870,526 9/1989 Maruta et al. ..... 361/1
4,879,575 11/1989 Maruta et al. ..... 399/23
5,144,384 9/1992 Fujita et al. ..... 399/19
5,262,834 11/1993 Kusaka et al. .
5,384,590 1/1995 Sugino ..... 347/140
5,457,516 10/1995 Kim ..... 399/37

*Primary Examiner*—Robert Beatty
*Attorney, Agent, or Firm*—Fitzpatrick, Cella, Harper & Scinto

[57] ABSTRACT

An image forming apparatus has an automatic power-off function for automatically shutting off a power source of the image forming apparatus when it is not operated for a predetermined time. A time until the automatic power-off function operates is made different in an ordinary standby mode and an interruption mode. The interruption mode is caused by an abnormality such as no paper. The time period in the interruption mode is made longer than the time period in the standby mode. The time period in the interruption mode is also made variable depending on the type of detected abnormality. The power-off time periods may be extended when an instruction is inputted via an operator. In addition, in an image forming apparatus having an original feeding device, a image forming mode is stored in memory and all the originals which have not been imaged will be ejected before the power is shut off in the interrupt mode.

25 Claims, 9 Drawing Sheets

IMAGE FORMING APPARATUS WITH POWER SHUT-OFF DEVICE

BACKGROUND OF THE INVENTION

1. Field of the Invention

The invention relates to an image forming apparatus having an automatic power-off function.

2. Related Background Art

Hitherto, from a viewpoint of a saving of energy, when no operation is performed for a predetermined time after completion of the image formation, an image forming apparatus activates an automatic power-off (automatic shut-off) function to automatically shut off a power source, thereby reducing a current supplying time to the image forming apparatus.

In recent years, even in an image forming apparatus of an ink jet system or an image forming apparatus of an electrophotographic system, there is an apparatus in which a warming-up time upon turn-on of the power source is short or an apparatus in which it can be almost immediately activated. Therefore, it is sufficient that a predetermined time which is required until the activation of the automatic power-off function is short. A waiting time until the image formation is enabled when the power source is again turned on is short. Therefore, even if the power source is frequently turned on and off, it is hardly troublesome. By such a function, a current supplying time to the image forming apparatus is reduced.

According to the image forming apparatus, however, there is a case where the image formation is interrupted during the image formation due to a cause of no paper or the like, the apparatus waits for the supplement of papers, and when the papers are supplemented, the image formation is again continued.

In such a case, since the automatic power-off time is short, in the image formation interrupted state, namely, when the image formation is interrupted due to the absence of papers, there is a case where the automatic power-off function is activated before the papers are supplemented, and the power source is turned off.

Particularly, there is a case where when the user is away from the apparatus during the image formation and is not aware of the interruption of the image formation due to the absence of papers or the like or it takes a long time to supplement the papers.

As mentioned above, when the automatic power-off function operates in the image formation interrupted state, in order to restart the image formation, the user must reset the set image forming mode (image formation copy quantity, zoom ratio, and the like).

Further, when images are formed from a plurality of originals by using an automatic document feeder (hereinafter, simply referred to as a feeder), there is a case where a few originals remain in the feeder because of the image formation interrupted state. In this state, the automatic power-off function operates. In order to restart the image formation by the user, the user has to remove the originals remaining in the feeder and to set the originals before the image formation interruption into the feeder.

Namely, when the automatic power-off function operates in the image formation interrupted state, since the power source is turned off in a manner similar to the ordinary turn-off of a power switch, when the user restart the image formation, the operation of the user is troublesome and there is a case where images are erroneously formed.

SUMMARY OF THE INVENTION

It is an object of the invention to provide an image forming apparatus and an automatic power-off method in which the above drawbacks can be eliminated.

Another object of the invention is to provide an image forming apparatus and an automatic power-off method in which an automatic power-off function can be effectively made operative and a good operability is obtained.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will now be described hereinbelow with reference to the drawings.

[Embodiment 1]

Figure 2:
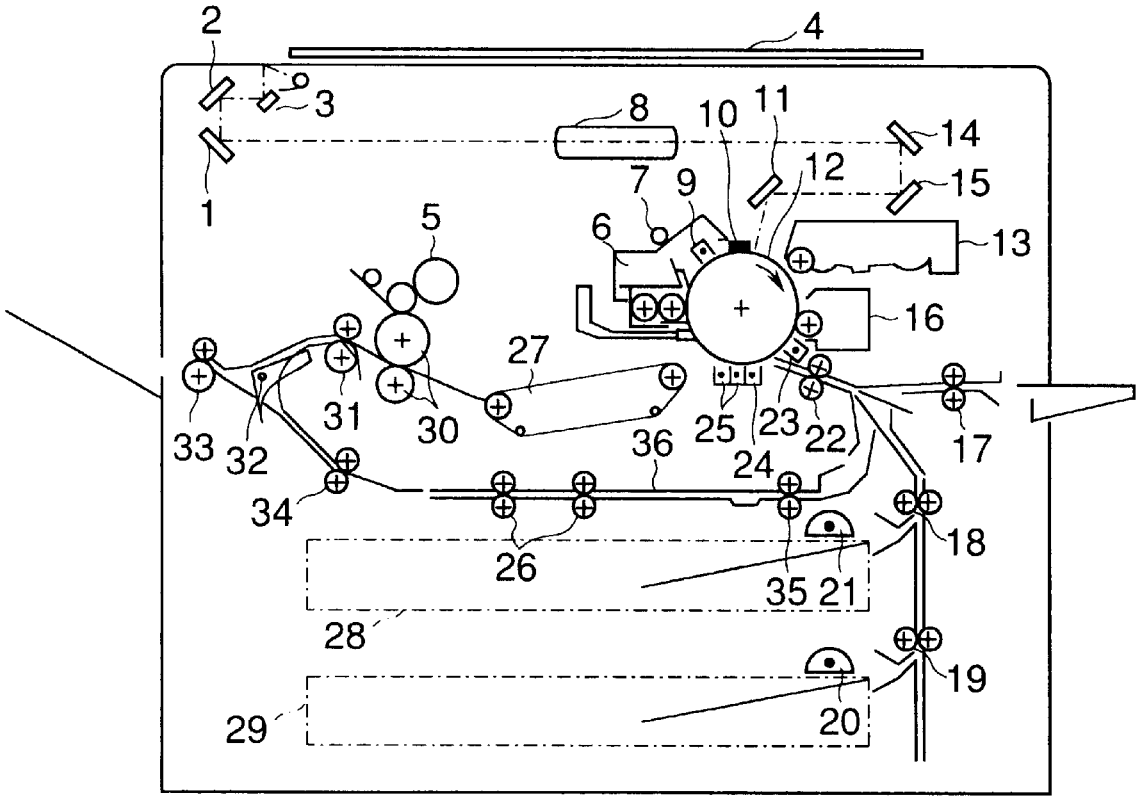
FIG. 2 is a cross sectional view of an image forming apparatus of the embodiment.

FIG. 2 is a cross sectional view showing a construction of an example of an image forming apparatus according to an embodiment of the invention.

The image forming apparatus of the embodiment is an image forming apparatus of an electrophotographic system and is mainly constructed by four blocks of a paper feed conveying system, an exposing system, an image forming system, and a control system.

The exposing system is constructed by an original supporting base plate, an original illuminating unit, an optical path unit, and the like. An original put on the original supporting base plate is exposed and scanned by an original illuminating lamp 4. A light image of the original is projected onto a photosensitive drum 12 through a plurality of mirrors and a zoom lens 8.

The image forming system is constructed by the photosensitive drum 12, a primary charging unit 9, a developing unit 16, a transfer charging unit 24, a separation charging unit 25, and the like. The surface of the photosensitive drum 12 which is rotating in the direction shown by an arrow A is uniformly charged by the primary charging unit 9. Charges of a non-image portion are eliminated from the charged drum surface by a blank exposing lamp 10 and an image portion is exposed by a projection light from the exposing system to the original. An electrostatic latent image formed on the photosensitive drum 12 by the image exposure is developed by the developing unit 16. After that, the developed image is transferred by the transfer charging unit 24 to a copy transfer paper conveyed from the paper feeding unit.

A remaining toner on the photosensitive drum 12 after the copy transfer is removed by a cleaning unit 6. Further, the remaining charges are eliminated by a pre-exposing lamp 7. Processes such as primary charging, image exposure, development, and transfer are again repeated.

The paper feed conveying system is constructed by a paper feeding unit, a conveying unit, a fixing unit, and the like. In the paper feeding operation from the cassette 28, the transfer paper is fed from the cassette 28 is fed by a cassette paper feed roller 21, and is conveyed to a resist roller 22. In the manual paper feeding operation with the hand, the transfer paper which was manually fed is conveyed to the resist roller 22 by a manual insertion paper feed roller 17.

The transfer paper conveyed to the resist roller 22 collides with the resist roller 22 and forms a loop, thereby performing an elimination of an oblique travelling and a timing correction for matching a front edge of the image.

The toner image developed on the photosensitive drum 12 is transferred by the transfer charging unit 24 onto the transfer paper conveyed to the resist roller 22. After that, the transfer paper is separated from the photosensitive drum 12 by a separation charging unit 25 and passes through a conveying unit 27 and is conveyed to a fixing roller 30.

Figure 3:
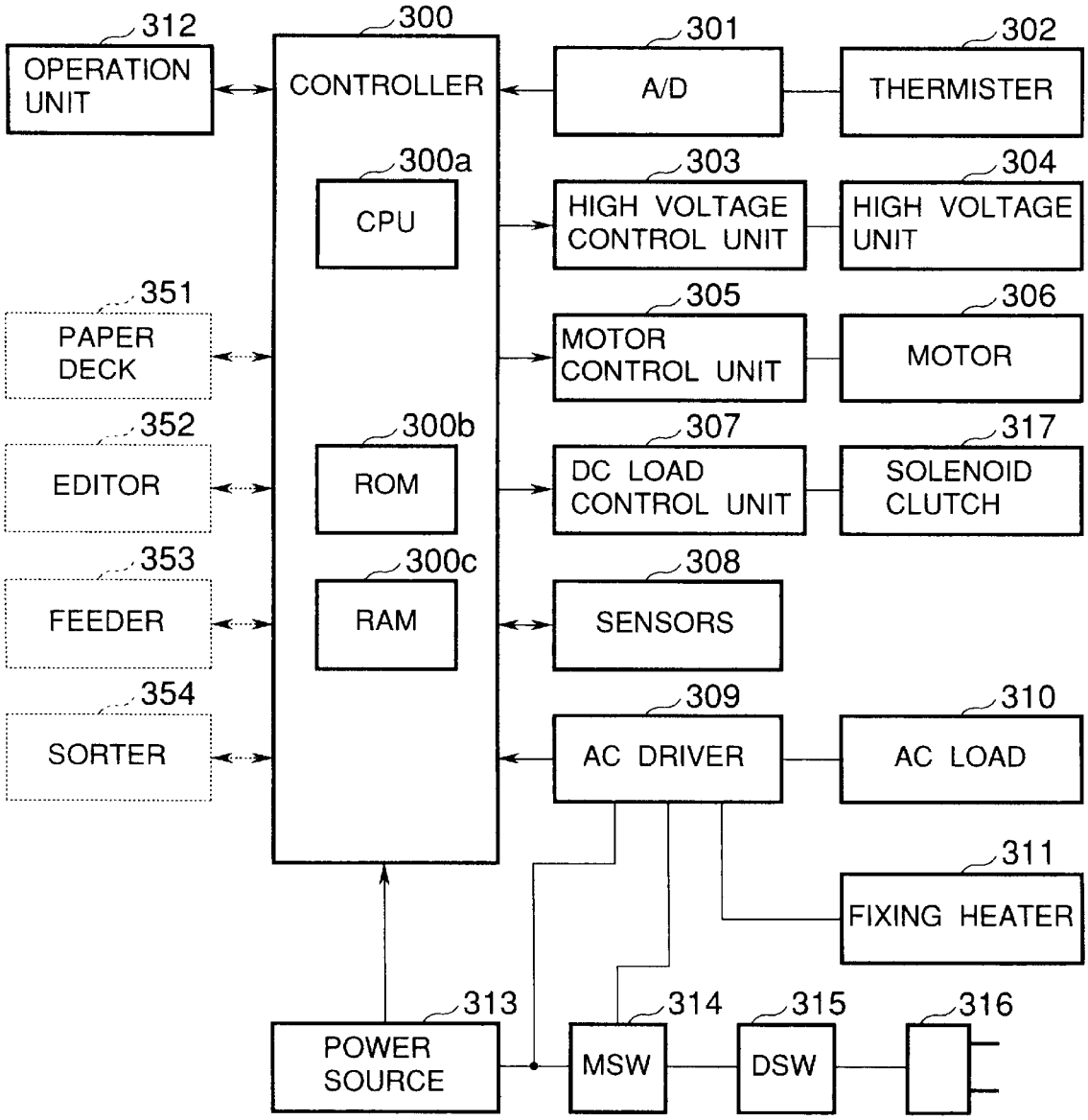
FIG. 3 is a block diagram of the image forming apparatus of the embodiment.

The fixing roller 30 is heated by a fixing heater (311 in FIG. 3). A temperature of the surface of the fixing roller 30 is detected by a thermister (302 in FIG. 3), thereby controlling so that the surface temperature of the fixing roller 30 is equal to a predetermined value. The toner image transferred onto the transfer paper conveyed by the fixing roller 30 is fixed with a heat and a pressure by the fixing roller 30.

As a fixing unit, it is desirable to use a fixing method of heating a fixing film by a planar fixing heater as disclosed in U.S. Pat. No. 5,262,834.

Such a fixing method is convenient for the present invention because there is no need to warm up the fixing unit.

In case of a normal copy mode, the transfer paper on which the toner image has been fixed is conveyed by a paper delivery roller 31 and is ejected to the outside of the apparatus.

FIG. 3 is a block diagram showing an example of the control system of the image forming apparatus of the embodiment.

In FIG. 3, reference numeral 300 denotes a control unit (controller) and is constructed by a CPU 300*a*, an ROM 300*b*, an RAM 300*c*, and the like and integratedly controls a copy sequence on the basis of programs stored in the ROM 300*b*.

Figure 8:
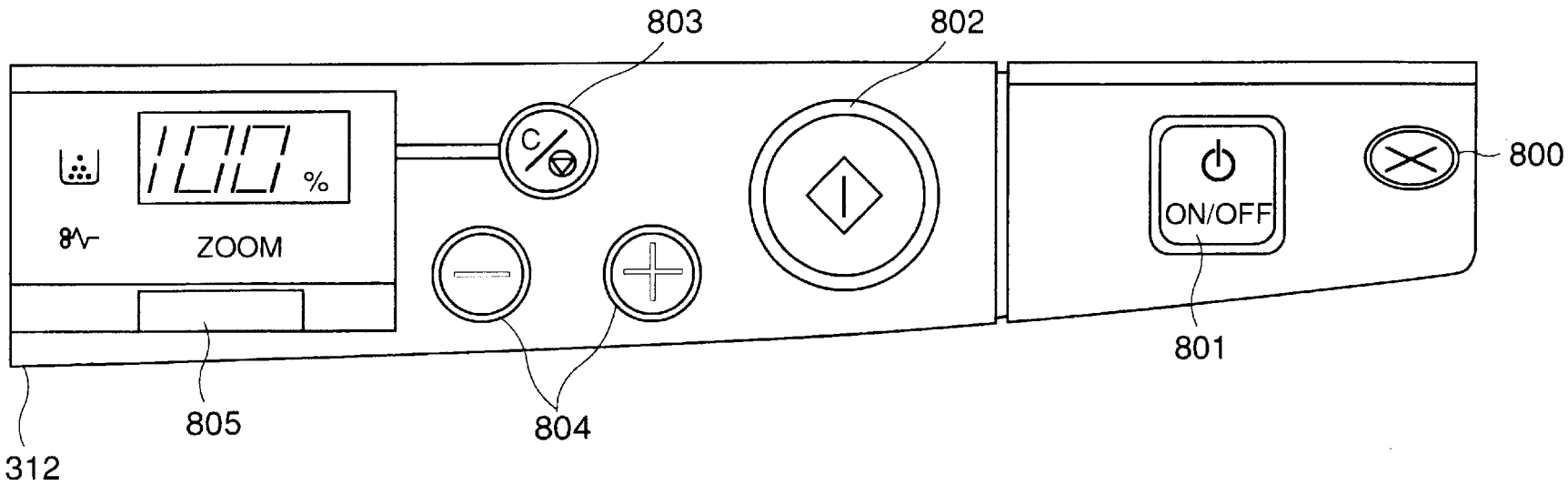
FIG. 8 is a perspective view of an operation unit of the embodiment.

A key input unit and a display unit are arranged in an operation unit 312. As shown in FIG. 8, the key input unit comprises: zoom/copy quantity input keys 804; a zoom (copy magnification) setting mode key 805; a start key 802 to instruct the start of the copying operation; a stop key 803 to instruct the stop of the copying operation or to set the set copy quantity into one; a power switch 801; an extension key 800 to extend a time which is required until the power source is automatically turned off; and the like. The display unit consists of an LED and the like to display a set state of an operating mode.

The thermister 302 detects the surface temperature of the fixing roller 30. A digital value which was A/D converted. by an A/D converter (301; not shown) is inputted to the controller 300.

A high voltage control unit 303 controls a high voltage unit 304 for applying predetermined potentials to a charging system such as primary charging unit 9, transfer charging unit 24, and the like, the developing unit 16, and the like.

A motor control unit 305 controls the driving of each of a stepping motor M2 and a main driving motor M1.

A DC load control unit 307 controls the driving of each of a solenoid clutch 317 or the like for the paper feed roller 21 and resist roller 22 or the like.

Reference numeral 308 denotes sensors to detect a paper jam of the transfer papers, positions of the optical system/lens system, and the like. Detection signals of the sensors 308 are inputted to the controller 300.

An AC driver 309 controls an AC power supply to each of an AC load 310 such as an original illuminating lamp 4 or the like and the fixing heater 311. The AC driver 309 also detects an abnormality of the fixing roller 311 or the like and turns off a main switch 314 with a shut-off function.

A DC power source 313 supplies DC power sources to the controller 300 and the like. An AC power source supplied from a power source plug 316 is inputted to the DC power source 313 through a door switch 315 and the main switch 314.

Figure 1:
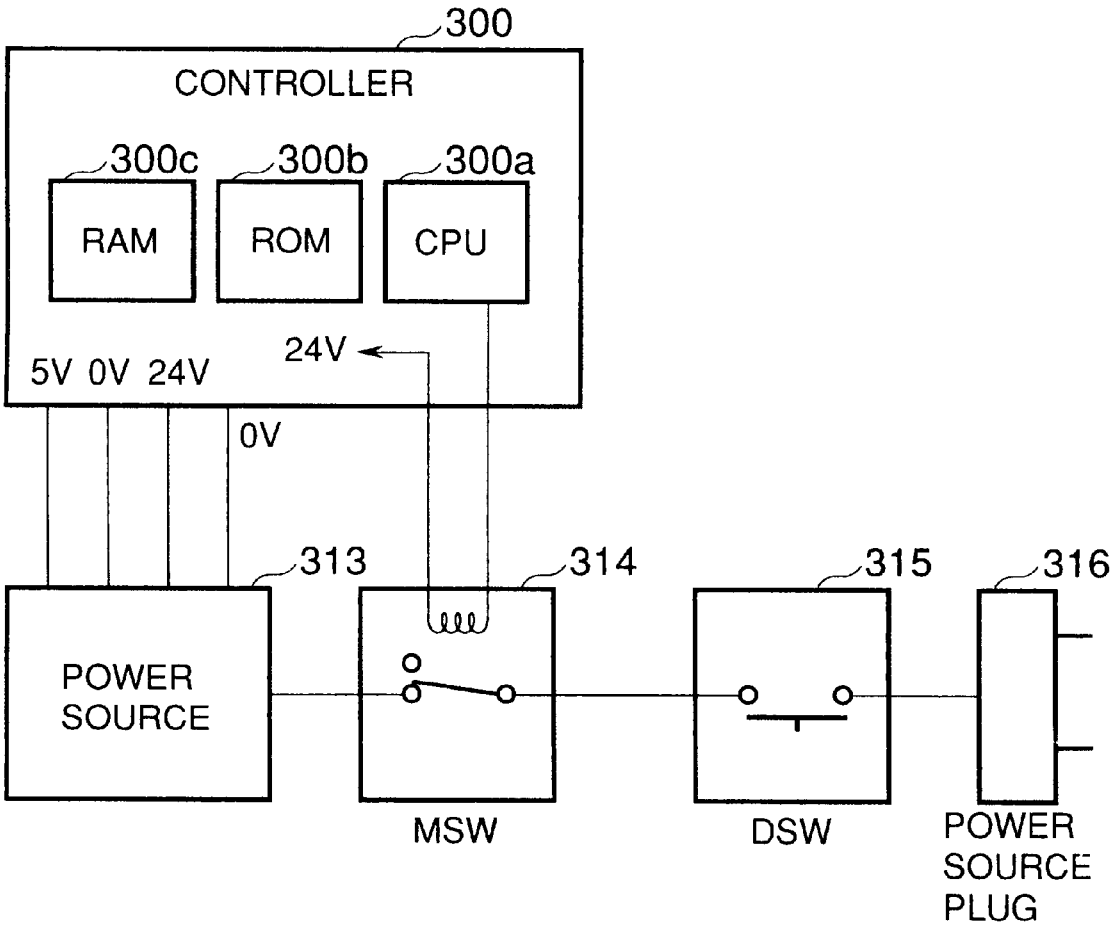
FIG. 1 is a block diagram showing a construction of an automatic power-off function of an embodiment of the invention.

FIG. 1 is a block diagram showing a construction of the automatic power-off (shut-off) function showing most preferably a feature of the embodiment.

After completion of the image formation, if no operation was performed for a predetermined time, the CPU 300*a* turns off the main switch 314 by control programs in the ROM 300*b* and RAM 300*c*. Thus, the image forming apparatus automatically shuts off the power supply to the DC power source 313 from the AC power source inputted from the power source plug 316, thereby setting the image forming apparatus into a non-power supplying state.

The image forming apparatus now enables the automatic power-off (automatic shut-off) function to automatically turn off the power source.

A specific control of the embodiment will now be described with reference to a flowchart shown in FIG. 4.

When the start key 802 is turned on, the apparatus enters a state in copying in step SP401.

A check is made in step SP402 to see if the transfer paper (hereinafter, simply referred to as a paper) has been extinguished during the copying.

In step SP403, a check is made to see if the copying operation of a desired copy quantity has been finished without causing a situation of no paper during the copying.

On the basis of the judgment in each of SP402 and SP403, the apparatus is set to either one of the automatic power-off control in the ordinary standby mode and the automatic power-off control in the image formation interrupted state due to the interruption by no paper.

When the copying operation corresponding to the set number of copies is finished in step SP403, the apparatus enters an ordinary standby mode for waiting for the next copy.

In step SP409, an automatic power-off timer (time until the automatic power-off function is made operative) t1 in the ordinary standby mode is started. In such a timer, a time count is decreased and when a count value is equal to 0, the automatic power-off function operates as described in FIG. 1.

In step SP410, when some key on the operation unit 312 is operated, it is regarded that there is a will of formation of an image. The processing routine is returned to step SP409 in order to clear the automatic power-off timer and to restart. When the key operated in step SP411 is the start key, the processing routine is returned to step SP401 and the copying operation is executed.

When there is no key operation in step SP410, step SP412 follows. When the automatic power-off timer is equal to 0 (t1 time elapses) in step SP412, the processing routine advances to step SP413 and the automatic power-off function operates as described in FIG. 1.

When the copying operation is interrupted because of no paper during the copying in step SP402, the apparatus enters a copy interruption mode in step SP404.

In step SP405, an automatic power-off timer (time until the automatic power-off function is made operative) t2 in the copy interruption mode is started. In this instance, a time count is decreased and when it is equal to 0, the automatic power-off function operates as described in FIG. 1.

In step SP406, when some key on the operation unit 312 is operated, it is regarded that there is a will of formation of an image. The processing routine is returned to step SP405 in order to clear the automatic power-off timer. When the key operated in step SP407 is the start key, the processing routine is returned to step SP401.

When there is no key operation in step SP406, the processing routine advances to step SP408. When the automatic power-off timer is equal to 0 (t2 time elapses) in step SP408, step SP413 follows and the automatic power-off function operates as described in FIG. 1.

It will be obviously understood in the embodiment that the time of the automatic power-off timer t2 in the copy interruption mode is a proper time when the user can supplement papers. It is considered that such a time is preferably set to about 30 minutes even in consideration of a time when the user leaves the apparatus and, further, a time when the user brings the papers.

In the ordinary standby mode, as described in the prior art, it is sufficient to set the automatic power-off timer t1 to a short time such as about 5 minutes and t1<t2.

The timing when the apparatus enters the copy (image formation) interruption mode is not limited to the timing corresponding to no paper as in the embodiment but can be also set to a timing corresponding to no toner, paper jam, or the like.

In an interruption mode due to a cause other than no paper, t2 can be also set to a time corresponding to the kind of interruption mode.

[Embodiment 2]

Figure 5:
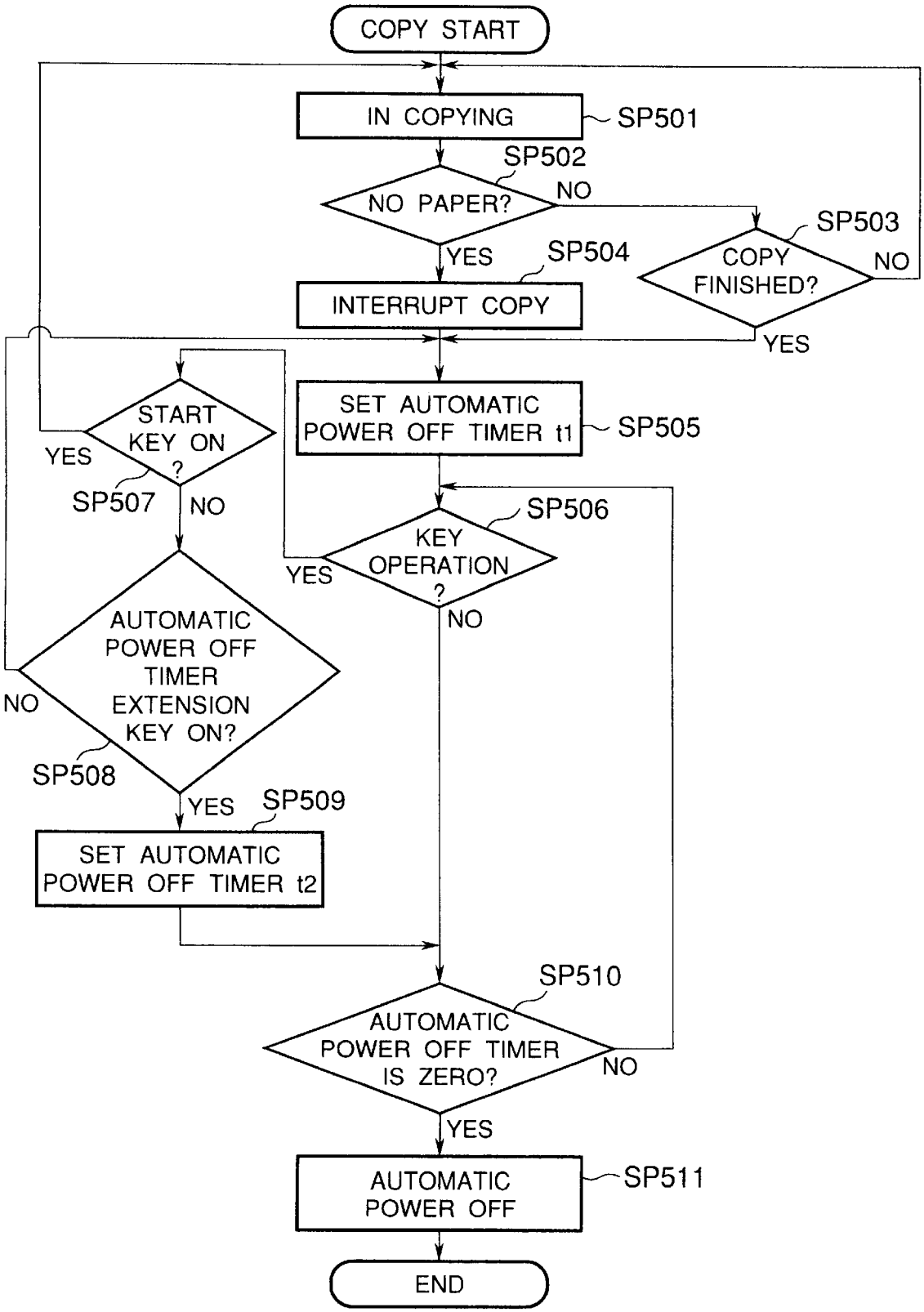
FIG. 5 is a flowchart showing a control of an embodiment 2.

An embodiment 2 will now be described with reference to a flowchart shown in FIG. 5.

When the start key 802 is turned on, the apparatus enters a copying mode in step SP501.

In step SP502, a check is made to see if there is no paper during the copying operation.

In step SP503, a check is made to see if the copying operation of a desired number of copies has been finished without causing a situation of no paper during the copying operation.

When it is judged in step SP502 that there is no paper during the copying operation, the apparatus enters the copy interruption mode in step SP504. The processing routine advances to step SP505.

In step SP503, when the copying operation of the set number of copies is finished, the apparatus enters the ordinary standby mode for waiting for the next copy. The processing routine advances to step SP505.

In step SP505, the automatic power-off timer t1 in the ordinary standby mode is started.

In step SP506, when some key on the operation unit 312 is operated, it is regarded that there is a will of formation of an image. The processing routine is returned from step SP507 or SP508 to step SP505 in order to clear the automatic power-off timer. When the operated key is the start key in step SP507, the processing routine is returned to step SP501.

When there is no key operation in step SP506, step SP510 follows. When the automatic power-off timer is equal to 0 (t1 time elapses) in step SP510, step SP511 follows and the automatic power-off function operates as described in FIG. 1.

The embodiment is characterized by steps SP508 and SP509.

When the automatic power-off timer extension key 800 on the operation unit 312 is depressed in step SP508, step SP509 follows. In step SP509, the automatic power-off timer t1 is reset and the automatic power-off timer t2 is started. When there is no key operation during such a period of time, the processing routine advances to step SP510.

When the automatic power-off timer is equal to 0 (t2 time elapses) in step SP510, step SP511 follows and the automatic power-off function operates as described in FIG. 1.

The setting of the extension mentioned above is cleared by forming the next image or by executing the automatic power-off operation. That is, after the automatic power-off timer extension key was depressed, the extension setting is effective until the next image is formed or the automatic power-off operation is executed. The extension setting is not held. Therefore, a timer time when the automatic power-off timer subsequently operates is set to t1.

There is a relation of t1<t2 in a manner similar to the embodiment 1.

It is also possible to accept the foregoing automatic power-off timer extension key only in the copy (image formation) interruption mode. Such a method can be realized by inserting a step of judging about the copy interruption mode before step SP508 in FIG. 5.

Further, the automatic power-off timer extension key is not limited to a single key as shown in FIG. 8. For example, a key which is not accepted in the copy interruption mode can be also substituted for the purpose of reduction of costs. Namely, since the copy quantity key is not accepted in the copy interruption mode, the copy quantity key can be also used as an automatic power-off time extension key.

Further, in an apparatus having a touch panel in a liquid crystal operation unit, the automatic power-off timer extension key can be also displayed on a liquid crystal display in only the copy interruption mode.

In a manner similar to the embodiment 1, the interruption mode is not limited to the timing of no paper.

[Embodiment 3]

Explanation will now be made with reference to a flowchart of FIG. 6.

When the start key 802 is turned on, the apparatus enters the copying mode in step SP601.

In step SP602, a check is made to see if, for example, there is no paper during the copying operation. In step SP603, a check is made to see if the copying operation of a desired number of copies has been finished without causing a situation of no paper in step SP603.

When the copying operation is interrupted because of no paper during the copying in step SP602, the apparatus enters the copy interruption mode in step SP604. Step SP605 follows.

When the copying operation is finished in step SP603, the apparatus enters the ordinary standby mode for waiting for the next copy. Step SP605 follows. In step SP605, the automatic power-off timer t1 in the ordinary standby mode is started. The time count of the timer t1 is decreased and when it is equal to 0, the automatic power-off function operates as described in FIG. 1.

When some key on the operation unit 312 is operated in step SP606, it is regarded that there is a will of formation of an image. The processing routine is returned from step SP607 to step SP605 in order to clear the automatic power-off timer. When the operated key is the start key in step SP607, the apparatus is returned to the copying mode in step SP601.

When there is no key operation in step SP606, step SP608 follows. When the automatic power-off timer is equal to 0 (t1 time elapses) in step SP608, step SP609 follows.

In step SP609, a copy mode (copy quantity, zoom ratio, and the like) before the automatic power-off function operates is stored into a non-volatile memory, for example, an RAM having backup means by a battery.

After that, the processing routine advances to step SP610 and the automatic power-off function operates as described in FIG. 1.

After that, when the power source is turned on by the user in step SP611, the copy mode (copy quantity, zoom ratio, etc.) which was backed up in step SP612 is automatically read out from the non-volatile memory and is set as a copy mode.

By restarting the copying operation in step SP613, therefore, the copying operation can be restarted from the state before the automatic power-off in step SP614.

The backup of the copy mode in step SP609 can be also performed in only the copy (image formation) interruption mode. Such a process can be realized by inserting a judgment about the copy interruption mode before step SP609 in FIG. 6.

The timing to enter the copy (image formation) interruption mode is not limited to the timing of no paper.

[Embodiment 4]

An embodiment 4 will now be described with reference to a flowchart of FIG. 7.

Figure 9:
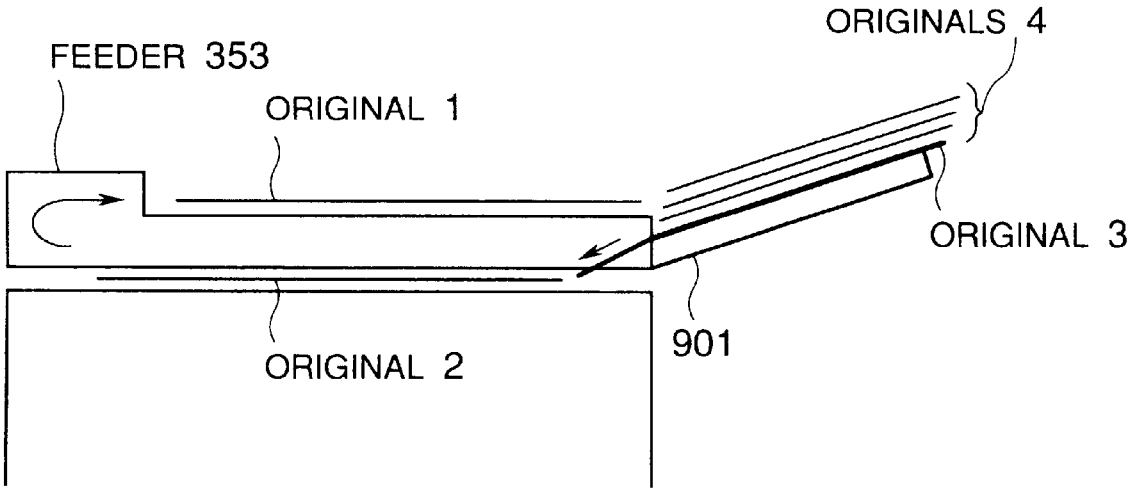
FIG. 9 is an explanatory diagram showing a state of a feeder of the embodiment 4.

In the image formation using a feeder (automatic document feeder) shown in FIG. 9, in the image formation interruption mode (state in which the copy of the original 1 in FIG. 9 has been finished and there is no paper for the original 2), when the automatic power-off function operates, the feeder automatically ejects all of the originals (originals 2 and 3 in FIG. 9) fed to the automatic document feeder and, after that, the automatic power-off function is made operative. When the image is again formed, therefore, the user doesn't need to eliminate the original remaining on a conveying path in the feeder.

In a copy mode using the feeder, when the automatic power-off timer is equal to 0, the following document ejecting routine is executed.

Figure 7:
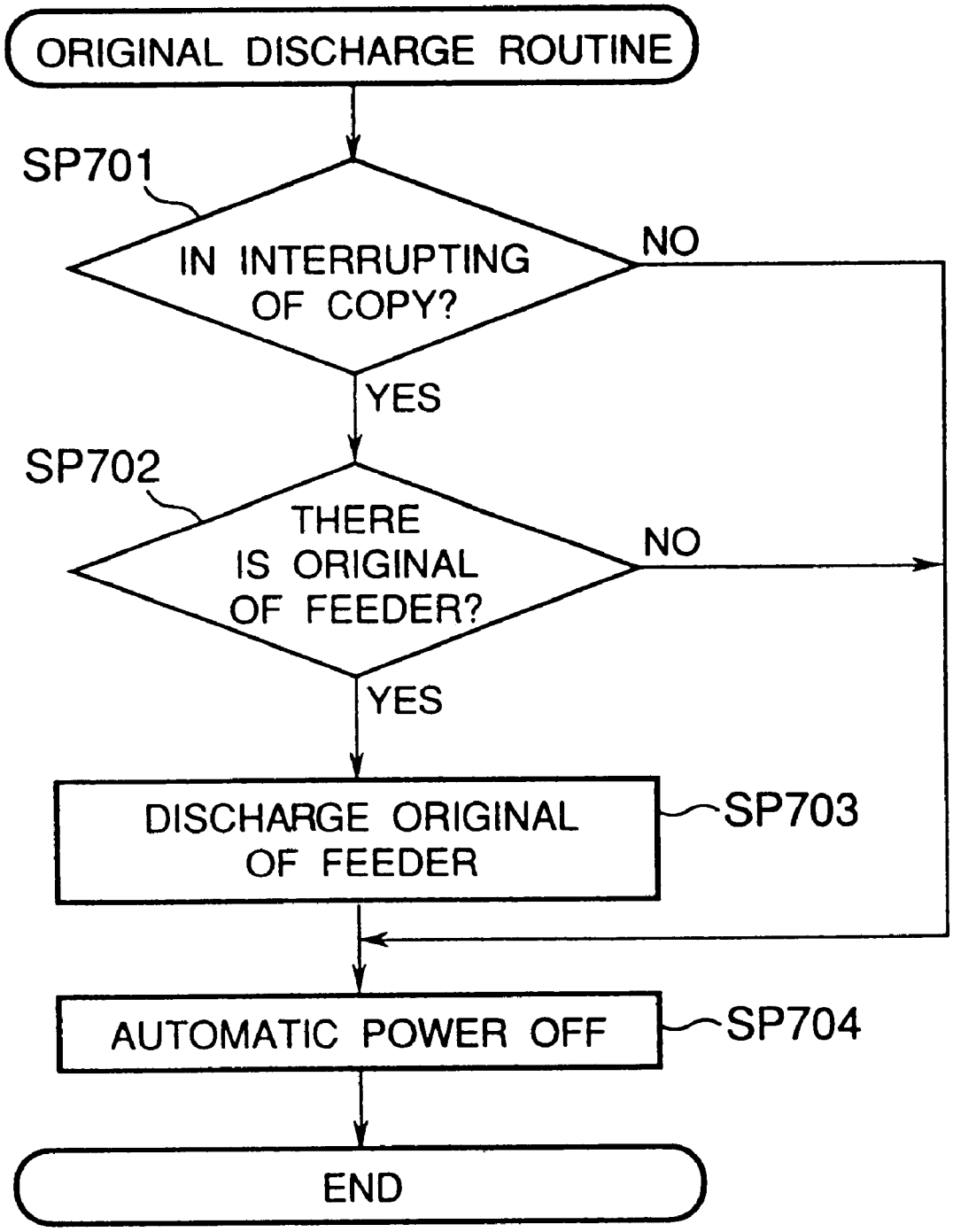
FIG. 7 is a flowchart showing a control of an embodiment 4.

When the apparatus is in the copy interruption mode in step SP701 in FIG. 7 and when there is the originals (originals 2 and 3 in FIG. 9) fed to the feeder in step SP702, the originals on the feeder are ejected in step SP703.

After the originals were ejected, the automatic power-off function operates in step SP704.

In the apparatus using the feeder, by combining with the controls in the embodiments 1 to 3 mentioned above, a further effective advantage can be obtained.

Figure 4:
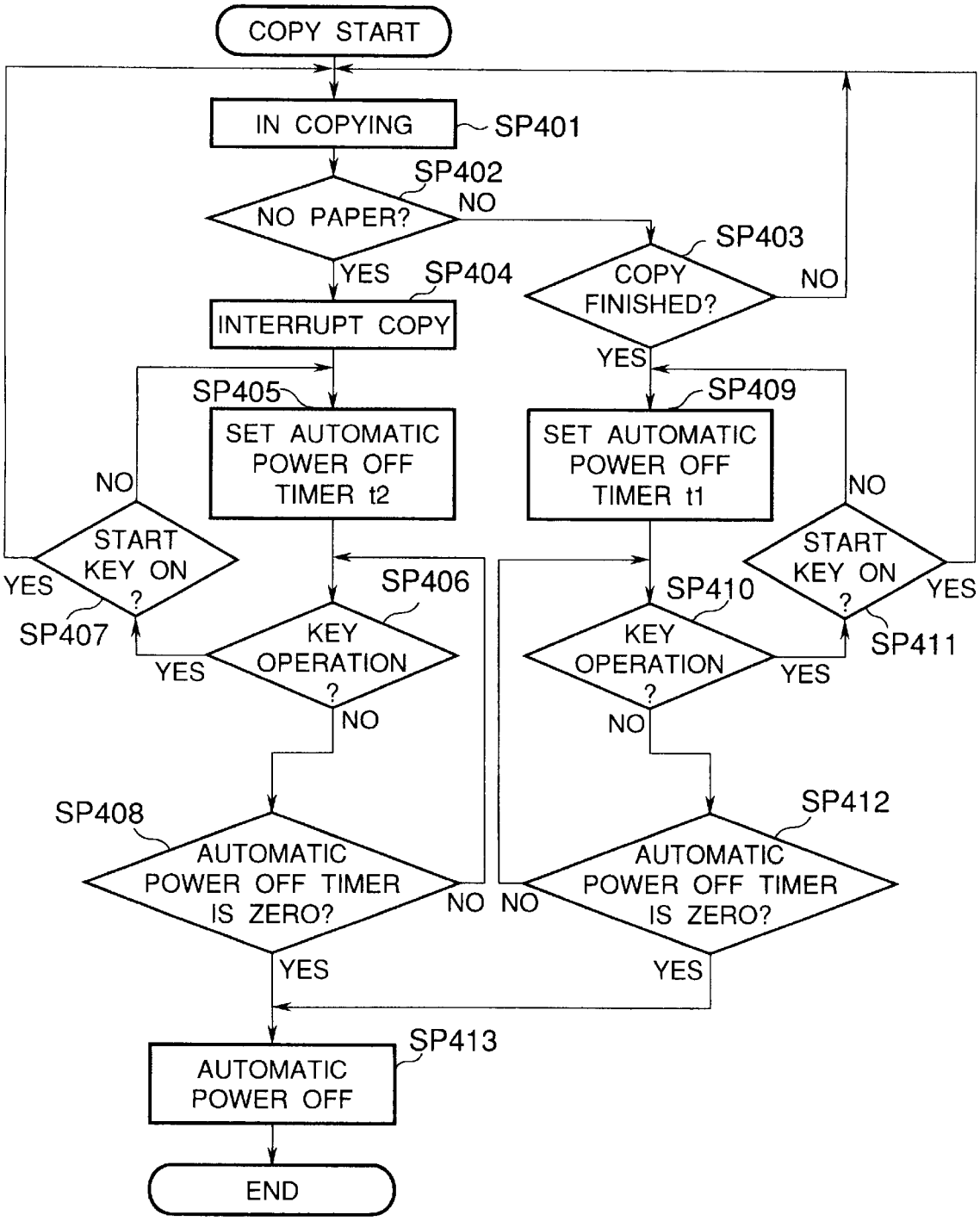
FIG. 4 is a flowchart showing a control of an embodiment 1.

In case of the embodiment 1, such a construction is realized by inserting the original ejecting routine of FIG. 7 before step SP413 in FIG. 4.

In case of the embodiment 2, such a construction is realized by inserting the original ejecting routine of FIG. 7 before step SP511.

Figure 6:
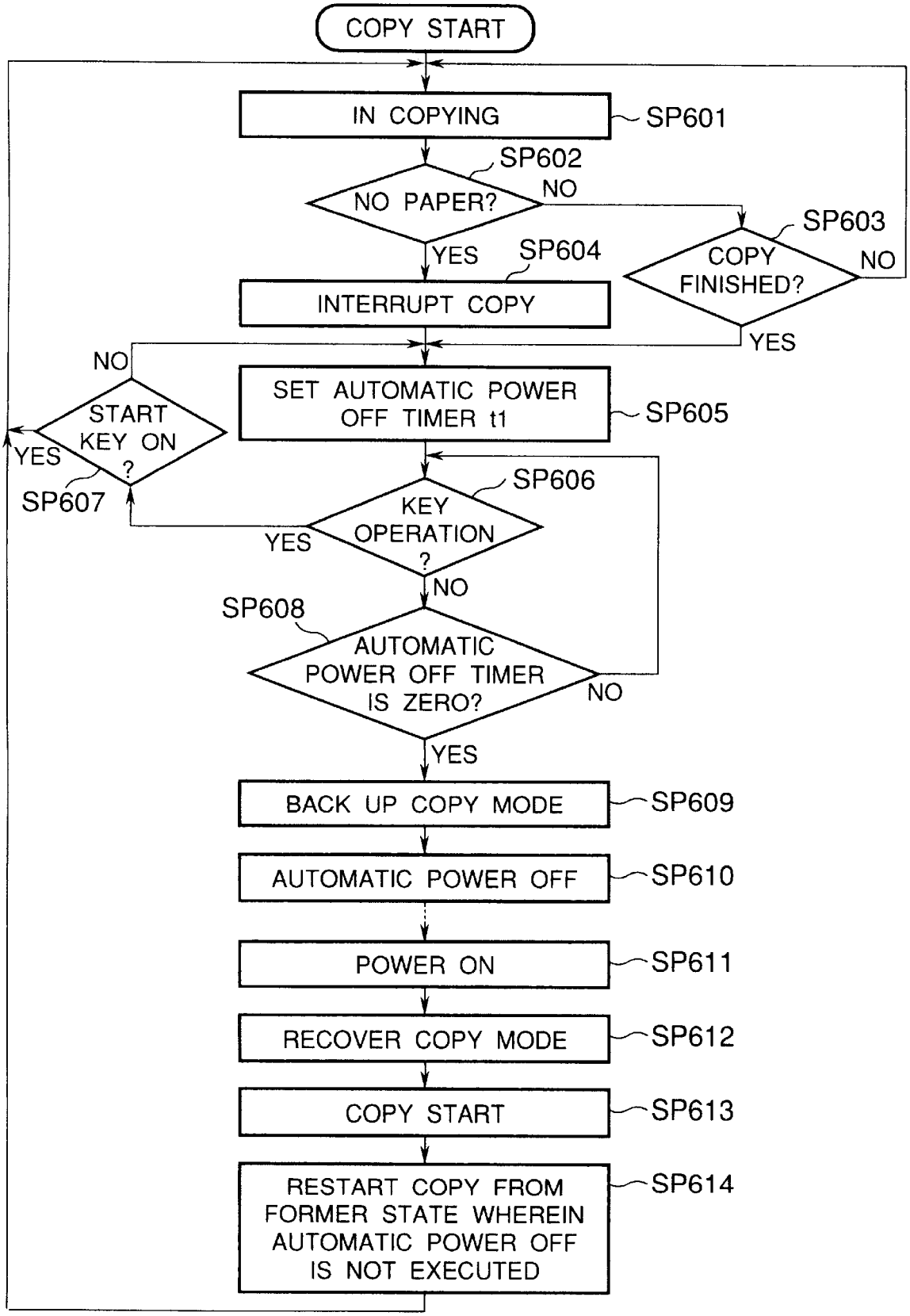
FIG. 6 is a flowchart showing a control of an embodiment 3.

In case of the embodiment 3, such a construction is realized by inserting the original ejecting routine of FIG. 7 before step SP610 in FIG. 6.

The feeder can be also controlled as follows.

When the automatic power-off function operates in the interruption mode, the feeder automatically ejects all of the originals (originals 2 and 3 in FIG. 9 and an original bundle 4) set in the feeder, and after that, the automatic power-off function is made operative. Thus, when the image is again formed, the user doesn't need to remove not only the originals remaining on the conveying path in the feeder but also the original remaining in an original inserting port (set position) 901 of the feeder.

Particularly, in the apparatus having the backup memory described in the embodiment 3, such a construction is effective when it is possible to recover. In a recovery copy mode, by setting the original into the feeder in a state in which the original was returned to the original position, the apparatus has a function for automatically idle feeding the copied original (original 1 in FIG. 9) up to the original before the interruption, it is sufficient for the user to again set all of the ejected originals into the feeder as they are (restart the copy from the original 2).

Such a control can be realized by replacing the case where there are the originals (originals 2 and 3 in FIG. 9) fed to the feeder in step SP702 in FIG. 7 to the case where there are the originals (originals 2 and 3 in FIG. 9 and the original bundle 4) set in the feeder.

Further, when the stop key 803 is depressed during the ejection of the originals, the original ejecting operation is interrupted. This is because if there are a large quantity of originals to be ejected and the user understands a setting method (method whereby the original is returned to the original position and is set) of the original at the time of restart of the formation of the image, it is more desirable for the operator to set by the operator rather than to automatically eject by the feeder. This is because when there are a large quantity of originals to be ejected, it takes a long time to eject them.

The present invention is not limited to the foregoing embodiments but many modifications and variations are possible within the spirit and scope of the appended claims of the invention.

What is claimed is:

1. An image forming apparatus comprising:

input means for inputting an instruction to form an image;

image forming means for forming an image on a recording medium in accordance with the instruction from said input means;

detecting means for detecting an abnormality of said image forming apparatus; and power shut-off means for shutting off a power source to said image forming apparatus when there is no instruction from said input means for a predetermined time in a state in which the image formation is stopped by a cause of the abnormality detected by said detecting means, wherein said power shut-off means sets a first time as the predetermined time when a first abnormality is detected by said detecting means, and sets a second time as the predetermined time when an abnormality different from the first abnormality is detected by said detecting means.

2. An image forming apparatus comprising:

first input means for inputting an instruction to form an image;

image forming means for forming an image onto a recording medium in accordance with an instruction from said first input means;

power shut-off means for shutting off a power source to said image forming apparatus when there is no instruction from said first input means for a first predetermined time in a state in which the image formation is not performed; and second input means for inputting an instruction to extend the first predetermined time, wherein said power shut-off means measures a second predetermined time longer than the first predetermined time according to the input from said second input means and shuts off the power source to said image forming apparatus when there is no input from said first input means after the second predetermined time has elapsed.

3. An apparatus according to claim 2, wherein said second input means is effective only in an interruption mode of the image formation.

4. An apparatus according to claim 3, wherein said interruption mode is a state in which a last of said recording medium has been consumed during the image formation.

5. An apparatus according to claim 2, wherein the instruction from said second input means is invalid when the power source is shut off or when the image formation is started.

6. An image forming apparatus comprising:

original feeding means for feeding plural originals one by one;

selecting means for selecting an image forming mode;

input means for inputting an instruction to form an image;

image forming means for forming an image of the original fed by said original feeding means onto a recording medium in accordance with the image forming mode selected by said selecting means in response to the instruction from said input means;

detecting means for detecting abnormality in said image forming apparatus;

power shut-off means for shutting off a power source to said image forming apparatus when there is no instruction from said input means for a predetermined time in a state in which the image formation is interrupted due to the abnormality detected by said detecting means;

a non-volatile memory for storing the image forming mode set before shutting off the power source at a time when the power source is shut off by said power shut-off means, and recovery means for controlling refeed of the original by said original feeding means on the basis of the image forming mode stored in said non-volatile memory for use in recovery from the image forming interruption after the power source was shut off, wherein said original feeding means discharges all the originals on which image forming is not yet performed before the power source is shut off by said power shut-off means.

7. An apparatus according to claim 6, further having:

setting means for setting the image forming mode stored in said non-volatile memory when the power source is again supplied to said image forming apparatus.

8. An apparatus according to claim 6, wherein the storage of the image forming mode into said non-volatile memory is executed only when the power source is shut off by said power shut-off means in the interruption mode of the image formation.

9. An apparatus according to claim 8, wherein said interruption mode is a state in which said recording medium has been consumed during the image formation.

10. An image forming apparatus comprising:

input means for inputting an instruction to form an image;

original feeding means for feeding an original to an exposing position, for stopping the fed original to the exposing position and for ejecting the original from the exposing position after completion of an exposure;

exposing means for exposing the original stopped at the exposing position by said original feeding means;

image forming means for forming the image of the original exposed by said exposing means onto a recording medium in accordance with the instruction from said input means; and power shut-off means for shutting off a power source to said image forming apparatus when there is no instruction from said input means for a predetermined time in a state in which the image formation is interrupted, wherein said original feeding means ejects the original stopped on the exposing position in said original feeding means before the power source is shut off by said power shut-off means.

11. An apparatus according to claim 10, wherein said original feeding means has a tray to stack a plurality of originals to be fed, and when said power source is shut off, said original feeding means feeds and ejects all of the originals on said tray.

12. A power shut-off method in an image forming apparatus, comprising the steps of:

inputting an instruction to form an image;

forming an image onto a recording medium in accordance with the instruction inputted;

detecting abnormality of the image forming apparatus; and shutting off a power source to the image forming apparatus when the instruction for the image formation is not inputted for a predetermined time in a state in which the image formation is stopped by a cause of the detected abnormality, wherein said shutting-off step sets a first time as the predetermined time when a first abnormality is detected in said detecting step, and sets a second time as the predetermined time when an abnormality different from the first abnormality is detected in said detecting step.

13. A power shut-off method in an image forming apparatus, comprising the steps of:

inputting a first instruction to form an image;

forming an image onto a recording medium in accordance with the instruction inputted;

shutting off a power source to the image forming apparatus when the first instruction is not inputted for a first predetermined time in a state in which the image formation is not performed; and measuring a second predetermined time longer than the first predetermined time when a second instruction to extend the first predetermined time and shutting off the power source to the image forming apparatus when there is no input of the first instruction in the second predetermined time.

14. A method according to claim 13, wherein the second instruction is valid only in the interruption mode of the image formation.

15. A method according to claim 14, wherein said interruption mode is a state in which said recording medium has been consumed during the image formation.

16. A method according to claim 13, wherein the second instruction is invalid when the power source is shut off or when the image formation is started.

17. A power shut-off method in an image forming apparatus having an original feeding means for feeding plural originals one by one, comprising the steps of:

selecting an image forming mode;

inputting an instruction to form an image;

forming an image of the original fed by the original feeding means onto a recording medium in accordance with the selected image forming mode in response to the instruction inputted;

detecting abnormality in the image forming apparatus;

shutting off a power source to said image forming apparatus when the instruction for the image formation is not inputted for a predetermined time in a state in which the image formation is interrupted due to the abnormality detected in said detecting step;

storing an image forming mode set before shutting off the power source at that time into a non-volatile memory in a case where the power source is shut off;

discharges all the originals on which the image forming is not yet performed, before the power source is shut off; and controlling refeed of the original by the original feeding means on the basis of the image forming mode stored in the non-volatile memory, for recovery from the image forming interrupted after the power source was shut off.

18. A method according to claim 17, further having the step of setting the image forming mode stored in said non-volatile memory when the power source to said image forming apparatus is again supplied.

19. A method according to claim 17, wherein the storage of said image forming mode into said non-volatile memory is executed only when the power source is shut off in the interruption mode of the image formation.

20. A method according to claim 19, wherein said interruption mode is a state in which said recording medium has been consumed during the image formation.

21. A power shut-off method in an image forming apparatus having a document feeder for feeding an original to an exposure position, stop the original, and discharging the original from the exposure position after exposure terminated, comprising the steps of:

inputting an instruction to form an image;

forming an image stopped at the exposing position onto a recording medium in accordance with the instruction inputted;

shutting off a power source to the image forming apparatus when the instruction for the image formation is not inputted for a first predetermined time in a state in which the image formation is interrupted; and ejecting the original stopped on the exposing position in the document feeder when the power source is shut off.

22. An image forming apparatus comprising:

first input means for setting an image forming mode;

second input means for inputting an instruction to form an image;

image forming means for forming the image onto a recording medium in accordance with the instruction from said second input means;

power shut-off means for shutting off a power source to said image forming apparatus when there is no instruction from said second input means for a predetermined time in a state in which the image formation is not performed; and third input means for inputting an instruction to extend the predetermined time independently of the input by said first input means, wherein said power shut-off means extends the predetermined time in accordance with the input from said third input means.

23. An apparatus according to claim 22, further comprising detecting means for detecting abnormality of said image formation apparatus, and wherein said third input means is operable in a state that the image formation is being interrupted due to the abnormality detected by said detecting means.

24. A power shut-off method in an image forming apparatus comprising:

a first input step which sets an image forming mode;

a second input step which inputs an instruction to form an image;

an image forming step which forms the image onto a recording medium in accordance with the instruction in said second input step;

a power shut-off step which shuts off a power source to said image forming apparatus when there is no instruction in said second input step for a predetermined time in a state in which the image formation is not performed; and a third input step which inputs an instruction to extend the predetermined time independently of the input in said first input step, wherein the predetermined time is extended in accordance with the input in said third input step.

25. A method according to claim 24, further comprising a detecting step of detecting abnormality of said image formation apparatus, and wherein said third input step is operable in a state that the image formation is being interrupted due to the abnormality detected in said detecting step.

* * * * *